United States Patent [19]

Bosquet et al.

[11] Patent Number: 4,696,723

[45] Date of Patent: Sep. 29, 1987

[54] PROCESS FOR REPAIRING THE TUBES OF A STEAM GENERATOR

[75] Inventors: Herman Bosquet, Kallo; Stanislas F. Ulens, Belsele, both of Belgium

[73] Assignee: N.V. Verenigde Energiebedrijven Van Het Scheldeland Mechelsesteenweg, Antwerp, Belgium

[21] Appl. No.: 732,030

[22] Filed: May 8, 1985

[30] Foreign Application Priority Data

May 11, 1984 [BE] Belgium ..... 0/212.910

[51] Int. Cl.[4] ..... C25D 3/12; C25D 7/04

[52] U.S. Cl. ..... 204/16; 204/25; 29/157.4; 29/402.18; 138/97; 165/173

[58] Field of Search ..... 29/157.4, 157.3 C, 402.18, 29/460; 165/172, 173; 204/15, 16, 25, 49; 138/97

[56] References Cited

U.S. PATENT DOCUMENTS

| | | | |
|---|---|---|---|
| 69,986 | 10/1867 | Gee | 204/16 |
| 1,534,815 | 4/1925 | Setter | 29/402.18 X |
| 2,115,403 | 4/1938 | Verschragen | 204/16 |
| 2,137,806 | 11/1938 | Paige | 204/16 X |
| 3,568,721 | 3/1971 | Ross | 29/402.18 |
| 3,711,310 | 1/1973 | Leeper, Jr. | 29/402.18 X |
| 3,884,772 | 5/1975 | Shiga | 204/16 X |
| 4,199,414 | 4/1980 | Shum | 204/16 X |
| 4,246,088 | 1/1981 | Murphy et al. | 204/25 X |
| 4,502,924 | 3/1985 | Minami et al. | 204/16 |

FOREIGN PATENT DOCUMENTS

| | | | |
|---|---|---|---|
| 2421359 | 10/1979 | France . | |
| 44200 | 10/1983 | Japan | 204/25 |
| 299298 | 7/1929 | United Kingdom . | |

OTHER PUBLICATIONS

*Chemical Abstracts,* vol. 88, 1978, p. 452, "Restoration of Water Distribution Gate Valves by Chromium Plating In a Cold Self-Regulating Electrolyte", A. I. Kovbasyuk et al.; & T. R. Kishinev, S-KH Inst. 1974, 123, 99-102.

*Chemical Abstracts,* vol. 88, 1978, p. 452, Resume No. 80956w, "Restoration of Tractor Engine Sleeves by Wear-Resistance Chromium Coatings", M. P. Stratolat et al and T. R. Kishniev, S-KH. Inst. 1974, 123-102-7.

*Primary Examiner*—Charlie T. Moon

*Attorney, Agent, or Firm*—Sughrue, Mion, Zinn Macpeak & Seas

[57] ABSTRACT

For repairing the tubes (2') of a steam generator (1), an impervious metallic sleeve is formed along the defective area (26) of the internal wall of a tube (2') by a wet process. The surface treatment is carried out on the spot in the tube (2') by means of a nickel solution free from chlorine, preferably a nickel sulphamate solution free from chlorine.

3 Claims, 2 Drawing Figures

PROCESS FOR REPAIRING THE TUBES OF A STEAM GENERATOR

Figure 1:
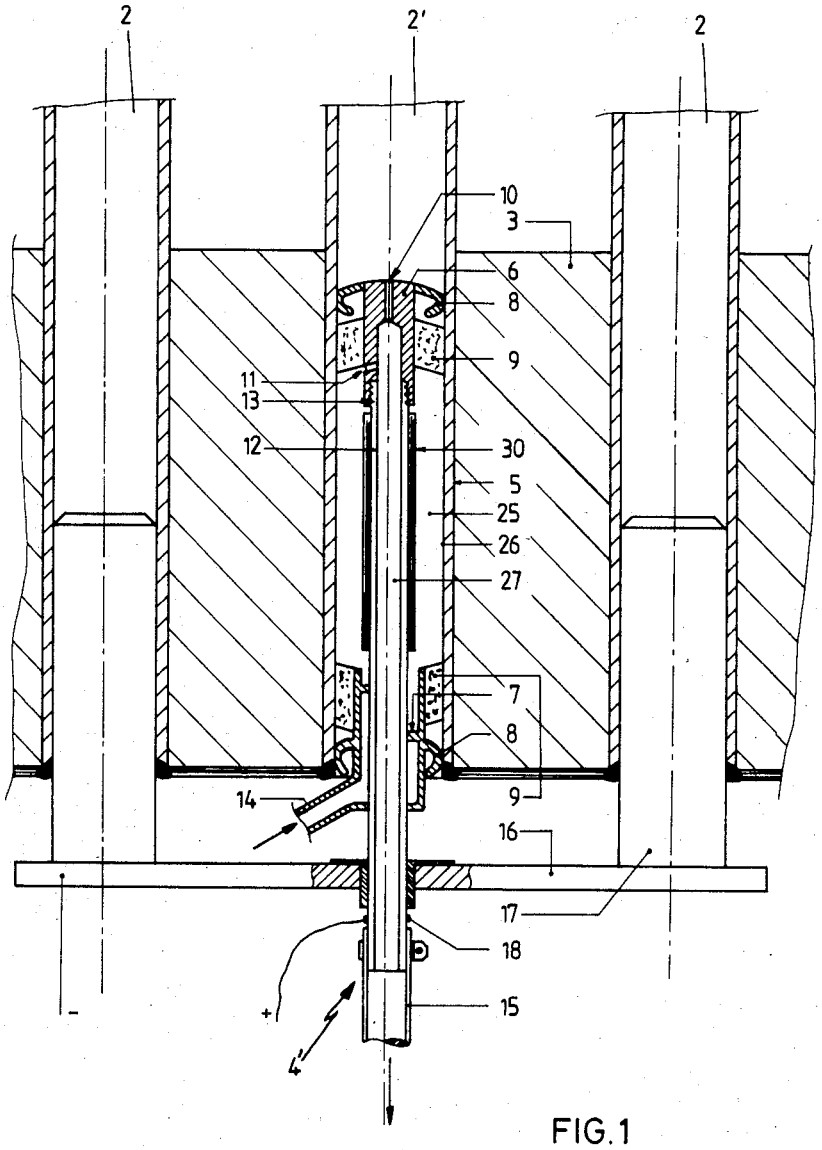

The present invention relates to a process for repairing the tubes of steam generators by supplying a tight internal metallic sleeve for covering a defective area.

It is principally used in a pressurized water nuclear power station of the PWR type when repairs are carried out by means of a sleeve in the tubes of a steam generator attacked by localised corrosion.

The steam generator is a heat exchanger in which the primary liquid which cools the reactor releases its heat, under a pressure of greater than 155 bars and a temperature of about 325° C., to a secondary circuit which delivers, by evaporation, the necessary steam for driving the turbine.

Although the tubes of a steam generator are produced from special non-oxidizing steels, so as to withstand the severe tensions and stresses of use and particularly corrosion, they can be damaged and sustain microscopic perforated cracks which are the source of leakages from the primary circuit to the secondary circuit.

The characteristics of corrosion by themselves present the danger that the primary liquid, which contains pollutive radio active compounds, will be mixed with the secondary liquid with the unfortunate consequence that it will be impossible to maintain the radioactivity below a specific level.

Currently, the most widespread repair process for repairing such steam generator tubes is to mask the damaged area of each tube by an internal metallic sleeve.

After precise insertion and positioning, the metallic sleeve is fixed to the tube, generally in the region of its two ends. Depending on the fixing method, the repairs thus carried out are of one or the other of the following types:

- sleeve permeable to water: at one of the ends, fixing is carried out by pressing a sleeve against the tube with permanent deformation. This process leaves a small gap which does not prevent all leakages but limits loss by infiltration;
- impervious sleeve: at least in the region of the two ends, the sleeve is fixed in an impervious manner by welding or soldering.

The principle disadvantage of these known repair methods is that they can induce internal tension in the tube by expansion and/or heating, in the region of the fixing areas.

The object of the invention is to remedy the above disadvantages. A process is proposed which allows an impervious bond to be obtained without deformation or local heating of the tube which is being repaired. The process for repairing the tubes of steam generators by supplying an impervious internal metallic sleeve for covering a defective area is characterised in that the said sleeve of the defective area of the internal wall of the tube is produced by a wet process carried out on the spot (i.e. in the field) in the tube.

In a particular embodiment, the said sleeve is formed by an electrolytic deposit of nickel from a nickel sulphamate solution which is free from chlorine.

According to a distinctive feature of the invention, a closed cavity is arranged in the defective tube by sealing the front part of the tube along a length of from 20 to 80 cm in the manner of an electrolytic cell, by means of a consumable nickel anode or a nickel alloy support which is immersed in the above nickel sulphamate solution and is held in the tube to be treated by two plugs of a synthetic material.

At the upper part of the electrolytic cell, a capillary release tube is provided through which the gases formed during the process can escape.

These and other characteristics and distinctive features of the invention will emerge from the following detailed description of a particular embodiment of the invention, with reference to the following drawings which schematically represent this embodiment.

Figure 2:
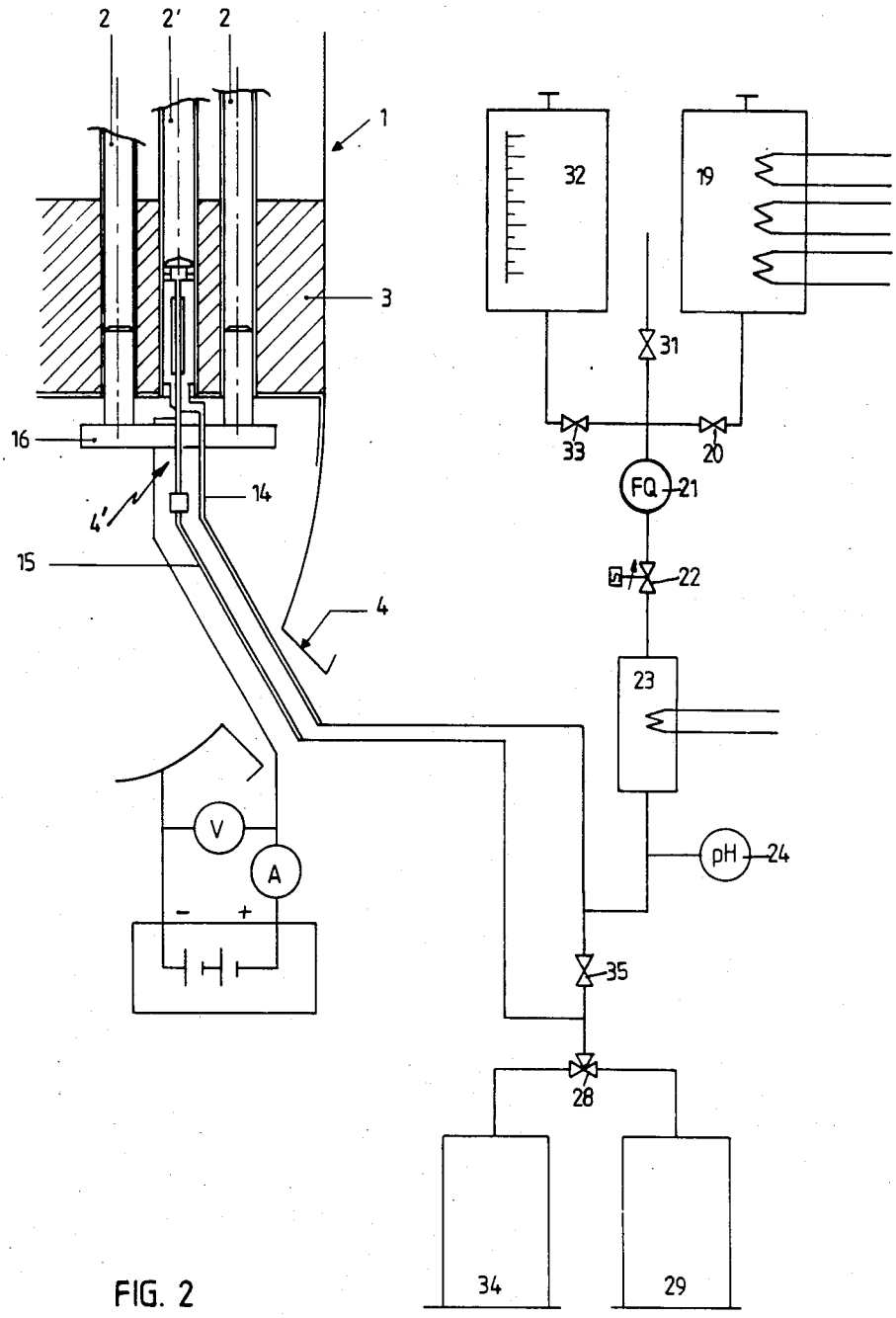

In these drawings:

FIG. 1 is a longitudinal axial section of an electrolytic cell for repairing tubes according to the invention; and FIG. 2 is a schematic view of the device shown in FIG. 1, mounted in the bundle of tubes of the steam generator.

In these two figures, identical reference numerals refer to identical or analogous elements.

As shown in FIG. 2, a steam generator, annotated in its entirety by the reference numeral 1, of a pressurized water nuclear power station, comprises a heat exchanger of non-oxidizing steel. Inside the bundle of tubes of the heat exchanger runs a primary circuit under a pressure of 155 bars and the tubes are surrounded externally by a secondary circuit. The tubes 2 have a diameter of about 20 mm and a length of about 12 m , bent around in the form of an inverted U. These tubes are produced from non-oxidizing austenitic alloys with a nickel base, commercially available under the trade mark INCONEL 600 ® or INCONEL SB 163 comprising 75% of nickel and from 13 to 18% of chromium and iron.

The nomenclature ASME is entitled "nickel-chromium-iron alloy UNS 6600 according to SB 163".

After a certain time, some tubes 2' may be damaged by corrosion under tension. This is caused by the severe conditions of use regarding pressure and temperature which apply to the primary liquid, which liquid consists of pure water with added boric acid and lithium hydroxide.

The phenomena of corrosion take place particularly at the level of the tubular plate 3.

Repair work naturally cannot be carried out until the operation of the nuclear power station is stopped, after which access can be obtained to the tubular plate 3 at the entrance of the steam generator 1.

As shown in FIG. 1, an electrolytic cell, represented in its entirety by the reference numeral 4', is formed on the spot along the interior of the damaged tube 2'.

The process according to the invention provides a frontal piece 5 with a view to sealing the tube 2' by two stoppers. The material necessary for this object comprises:

an upper section 6, preferably produced from a synthetic material and provided with elastic projections or blades 8 for centering the apparatus;

a ring 9 of synthetic foam which ensures an impervious connection between the upper section 6 and the tube 2';

a capillary outlet conduit 10 for the gases formed during the process;

a connecting conduit 11 between the external part and the internal part of the anode 12, for ensuring circulation of the electrolyte:

a tubular hollow electrode 12 produced from nickel, the length of which is adapted to the length of the frontal piece 5 to be repaired. This section is connected by a threading 13;

a supply conduit 14 for ensuring the supply of fresh electrolytic solution;

an outlet conduit 15 for the electrolytic solution;

a lower section 7 provided with elastic projections 8 and an impervious ring 9 of synthetic material.

The lower section constitutes part of a holding device 16 for fixing the lower part of the two elastic plugs 17 to a tubular plate 3.

The holding device consists of two elastic plugs 17 which are introduced and supplied to the neighbouring tubes.

The defective section 5 of the tube 2' on which a sleeve is to be arranged should be pre-treated before being subjected to a surface treatment with a view to being repaired. The interior surface of the tube 2' should in particular be sufficiently clean so that it is possible to adhere the metal deposited perfectly, this generally requiring previous cleaning of the surface.

The sleeve is formed along the defective area 26 of the interior wall of the tube 2' by means of a surface treatment carried out on the spot, in the tube 2', for example by deposition from a liquid phase which is in contact with the surface to be covered.

If gases are released during treatment, which is generally the case, the process does not apply to horizontal tubes, because the contact between the metal and the liquid phase is no longer ensured in the region of the synthetic layer.

Since a large number of electrolytic bath compositions are described in the literature which meet the diverse requirements of the mechanical characteristics, the thickness and the speed of the deposit, the invention describes the precise operating conditions for producing a covering resistant to corrosion by means of an electrolytic bath free from chlorine.

The presence of chlorine ions, generally in the form of from 250 to 300 g of hydrated nickel chloride, is still considered today as an indispensable condition for avoiding the passivation of a nickel anode and thus ensuring a sufficient speed of growth of the deposited nickel layer.

As for the remainder of the primary circuit, the use of chlorine ions is completely ruled out owing to the possible development of corrosion attacks under tension.

Inthe following paragraphs, the compositions and the principle operational characteristics of two methods of operation of electrodeposit baths are given.

The internal surface of the steam generator is cleaned along a distance corresponding to the first 60 cm of the bundle of tubes. The deposits and oxides which are formed during operation are eliminated by cleaning with a cylindrical metallic brush.

Careful cleaning is finally carried out by means of a silk brush.

The electrolytic solution is prepared by mixing sulphamic acid (amino-sulphonic) in crystallized form and nickel carbonate in the presence of hydrolysis inhibitors. The reaction is carried out according to the following equation:

$$NiCO_2+2NH_2SO_3H \rightarrow Ni(H_2NSO_3)_2+H_2O+CO_2$$

and procures a concentrated 48° Baumé concentrated solution containing from 550 to 650 g/l of nickel sulphamate. The purity of the nickel sulphamate solution is greater than 99%.

The composition of the electrolytic bath substantially influences the quality of the covering as regards adhesion to a support, constant thickness, resistance to corrosion, hardness and the weldability.

By way of example, the decomposition of the nickel sulphamate is prevented by the addition of some additives, such as an inhibitor. The decomposition is likewise prevented by addition of small quantities of boric acid (about 25 g/l) by which the pH is adjusted to between 3 and 5.

The addition of colloids allows the brilliance of the nickel layer to be improved.

To prevent hydrogen gas pockets, small quantities of softening agents are added. For this, alkyl sulphates are used for example lauryl sulphate (from 0.15 to 0.30 g/l).

As shown in FIG. 2, the freshly prepared electrolytic solution is poured into the receiver 19 and flows under gravity through the valve 20, the debit meter 21, the regulating valve 22, the thermostat 23, the pH meter 24 and enters the electrolysis cell 1 by the supply conduit 14.

The fresh electrolytic solution flows into the annular space 25 formed by the damaged wall of the tube 2 of the steam generator. This wall is limited by the upper bolts 6 and the lower bolts 7. This space 25 is completely filled with liquid.

The liquid overflows through an upper connecting conduit and flows through the annular space 27 of the hollow cavity of the electrode 12 towards the outlet conduit 15.

The used solution is collected by the conduit and the three-channel valve 28 into glass vessel 29, from which the solution is discharged or regenerated so that it can be used again in one of the receivers 4 or 5. The flow is adjusted to the desired value of the speed of flow desired in electrolysis, about 1 to 15 cm/s.

The temperature is kept constant at from 55° to 65° C. and at a pH of from 3 to 5 Soerensen.

A small hollow tube with a nickel base, preferably nickel S is used as anode. This anode is produced, for example, from a tube of extruded titanium, on which a covering of consumable nickel 30 is deposited electrolytically with a sulphur content of 0.2%. The nickel S has the advantage of not passivating. The ends of the tube 12 are provided with threadings to allow deodorizing with the upper head 6 and the lower head 7.

As soon as the operating conditions are achieved, a potential difference between the two electrodes, equal to from 2 to 5 V, is established owing to the stabilized external source.

The operating conditions should be carefully maintained for the temperature at the entrance of the cell, the difference in potential, the density of current, the flow and the composition.

The gases which are possibly formed in the electrolysis cell escape at the upper part through the capillary tube, while the liquid is retained by its greater viscosity.

TABLE 1

Composition of a solution of nickel sulphamate under the operating conditions

| compound | Optimum content | acceptable limits |
|---|---|---|
| nickel sulphamate | 600 g/l | 550–650 g/l |
| boric acid | 25 g/l | 30–40 g/l |
| lauryl sulphate sodium salt (adjuvant for preventing | 0.3 g/l | 0.1–0.5 g/l |

TABLE 1-continued

| Composition of a solution of nickel sulphamate under the operating conditions | | |
|---|---|---|
| compound | Optimum content | acceptable limits |
| hydrogen gas pockets) | | |
| temperature | 25° C. | 55–60° C. |
| Density of current | 20 A/dm$^2$ | |
| pH | 4 | 3–5 Soerensen |
| Speed of flow of the electrolyte | 10 cm/s | 1–15 cm/s |
| Diameter of the tube to be repaired | 20 mm | — |
| Diameter of the nickel anode | 11 mm | — |

As soon as the desired thickness of the sleeve is achieved, the electric supply current is interrupted and the equipment is emptied and rinsed with distilled water in the following manner:

emptying: the value 20, the pressure reducing valve 31 and the outlet valve 35 are opened;

rinsing: the outlet valve 35 and the pressure reducing valve 31 are closed, the valve 28 is turned towards the vat 34 for receiving the rinsing liquid and the valve 33 is opened; and emptying: the valve 33 is closed, the outlet valve 35 and the pressure reducing valve 31 are opened.

The apparatus is withdrawn from the repaired tube. This withdrawal of the apparatus is made possible by the fact that the upper section consists of an elastic polyurethane foam which is applied below the sleeve.

In addition to the fact that the sleeve causes no internal tension in the repaired tube, the process has the following advantages:

(1) a major reduction in the time during which the employee charged with the repair is exposed to irradiation in the steam generator, compared with the installation of mechanical sleeves currently known;

(2) simplicity of the operations necessary in the interior of the closed space of the steam generator;

(3) possibility of repairing several tubes simultaneously;

(4) uniform thickness of from 0.10 to 0.15 mm of pure nickel;

(5) in contrast to the known processes, an internal tension in the material of any greater than 100 Mpa is avoided in the wall of the tube:

(6) great resistance of the sleeve thus produced to corrosion of the alkaline type.

The resistance of the sleeve has been proved by numerous tests of corrosion under tension in an alkaline medium and in pure water which is charged with hydrogen, at a temperature of 350° C.

Profilometric experiments, measurements with Foucault current, and experiments of flickering measured by means of a photoelectric cell do not reveal any supply fault.

The intensity of the current is of an extent dependent on the immersed surface of the cathode.

The intensity of the current is regulated by the difference in potential between the electrodes. The conductivity of the bath and the distance between the hollow nickel anode and the wall of the tube are determining in this case.

If several tubes are repaired simultaneously, the intensity of the current should be regulated separately in the different cells.

In particular cases, the deposits of metal take place according to a process totally free from current. The nickel covering can be deposited, for example, by catalytic reduction starting from a solution of nickel salts by means of sodium hypophosphites free from chlorine.

It is evident that the invention is in no way limited to the embodiment described above, which is described rather by way of example. Numerous modifications can be made without deviating from the scope of the following claims.

We claim:

1. A process for repairing the tubes (2) of steam generators by supplying an impervious internal metallic sleeve for covering a defective area, characterised in forming said sleeve by electrolytically depositing nickel from a nickel sulphamate soulution free from chlorine along the defective area (26) of the internal wall of the tube (2'), said depositing step including providing a closed cavity by sealing the front part (26) of the tube (2') along a length of from 20 to 80 cm in the manner of an electrolytic cell.

2. A process according to claim 1, characterised in providing an electrolytic cell having a consumable nickel or nickel alloy anode (12) immersed in the nickel sulphamate solution and held in the tube to be treated (2') by two plugs of synthetic material (17) elastically inserted into two neighboring tubes.

3. A process according to claim 1, characterised in providing at the upper part of the electrolytic cell a capillary orifice (10) through which the gases released during the process can escape.

* * * * *